US011585568B2

(12) United States Patent
Kitagawa et al.

(10) Patent No.: US 11,585,568 B2
(45) Date of Patent: Feb. 21, 2023

(54) DRAINAGE MECHANISM AND AIR CONDITIONING SYSTEM INCLUDING THE SAME

(71) Applicant: DAIKIN INDUSTRIES, LTD., Osaka (JP)

(72) Inventors: Keita Kitagawa, Osaka (JP); Hiromune Matsuoka, Osaka (JP); Akihiro Eguchi, Osaka (JP); Yoshito Matsuda, Osaka (JP); Tarou Yasumatsu, Osaka (JP); Takayoshi Yamamoto, Osaka (JP); Tsunehisa Sanagi, Osaka (JP); Seisuke Itou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/708,420

(22) Filed: Mar. 30, 2022

(65) Prior Publication Data

US 2022/0221189 A1 Jul. 14, 2022

Related U.S. Application Data

(63) Continuation of application No. PCT/JP2020/034362, filed on Sep. 10, 2020.

(30) Foreign Application Priority Data

Sep. 30, 2019 (JP) ..... JP2019-180816

(51) Int. Cl.
*F24F 13/02* (2006.01)
*F24F 13/22* (2006.01)

(52) U.S. Cl.
CPC ..... *F24F 13/222* (2013.01); *F24F 2013/227* (2013.01)

(58) Field of Classification Search
CPC ..... F24F 13/222; F24F 2013/227
(Continued)

(56) References Cited

U.S. PATENT DOCUMENTS 6,718,788 B1 * 4/2004 Shuck ..... F25D 21/14 220/571
8,156,956 B1 * 4/2012 Coogle ..... F16L 55/07 137/271

(Continued)

FOREIGN PATENT DOCUMENTS

JP S63-101780 U 7/1988
JP H03-118432 U 12/1991

(Continued)

OTHER PUBLICATIONS

International Preliminary Report on Patentability issued in corresponding International Application No. PCT/JP2020/034362 dated Apr. 5, 2022 (5 pages).

(Continued)

*Primary Examiner* — Filip Zec
(74) *Attorney, Agent, or Firm* — Osha Bergman Watanabe & Burton LLP

(57) ABSTRACT

A drainage mechanism is connected to a drain pump that sucks water from a drain pan. The drainage mechanism includes a connecting part that connects to the drain pump, a first flow path, a folded part, and a second flow path. The first flow path extends upward from the connecting part. The folded part has a first end connected to an upper end of the first flow path and a second end on a side opposite to the first end. The folded part changes a direction of the water flowing therein from upward to downward. The second flow path extends from the second end. The second flow path is a pipe (Continued)

that has an inner diameter of 13 mm or less. The flow path area of the folded part is larger than the flow path area of the second flow path.

21 Claims, 11 Drawing Sheets

(58) Field of Classification Search
USPC ..... 62/285–291
See application file for complete search history.

(56) References Cited

U.S. PATENT DOCUMENTS

2006/0070658 A1* 4/2006 Nakata ..... F24F 1/0083 137/312
2008/0104988 A1* 5/2008 Lee ..... F24F 13/222 62/285
2008/0245802 A1* 10/2008 Gray ..... F24F 13/222 220/571
2016/0201941 A1* 7/2016 Hodges ..... B23P 6/00 62/56

FOREIGN PATENT DOCUMENTS

JP H05-203177 A 8/1993
JP H10-339465 A 12/1998
JP H11-351603 A 12/1999
WO 2004/040201 A1 5/2004

OTHER PUBLICATIONS

International Search Report issued in corresponding International Application No. PCT/JP2020/034362 dated Nov. 10, 2020 (2 pages).
Decision to Grant a Patent issued in corresponding Japanese Patent Application No. 2020-152226 dated Nov. 4, 2020 (5 pages).
Extended European Search Report issued in corresponding European Patent Application No. 20871230.7, dated Oct. 7, 2022 (5 pages).

* cited by examiner

DRAINAGE MECHANISM AND AIR CONDITIONING SYSTEM INCLUDING THE SAME

TECHNICAL FIELD

The present disclosure relates to a drainage mechanism, in particular to a drainage mechanism connected to a drain pump that sucks water from a drain pan of an air conditioning indoor unit. In addition, the present disclosure relates to an air conditioning system including the drainage mechanism.

BACKGROUND

A technique of drainage with a pump is described in Patent Literature 1 (Japanese Laid-Open Patent Application No. H5-203177). This technique enables reliable drainage even when the space inside the ceiling is narrow and a sufficient pipe gradient cannot be obtained.

SUMMARY

A drainage mechanism of one or more embodiments is connected to a drain pump that sucks water from a drain pan. The drain pan receives water in an air conditioning indoor unit. The drainage mechanism includes a connecting part connected to the drain pump, a first flow path, a folded part, and a second flow path. The first flow path extends upward from the connecting part. The folded part includes a first end connected to an upper end of the first flow path and a second end on the opposite side of the first end. The folded part changes the direction of water flowing inside from upward to downward. The second flow path extends from the second end of the folded part. The second flow path is a pipe having an inner diameter of 13 mm or less. A flow path area of the folded part is larger than a flow path area of the second flow path.

BRIEF DESCRIPTION OF THE DRAWINGS

FIG. 1 is a diagram showing a refrigerant circuit of an air conditioning apparatus including an air conditioning indoor unit to which a drainage mechanism is connected, and the like.

DETAILED DESCRIPTION

A drainage mechanism described below is connected to an air conditioning indoor unit of an air conditioning apparatus, especially to a ceiling-mounted air conditioning indoor unit. The air conditioning apparatus 10 and the air conditioning indoor unit 12 are installed in a building and then form an air conditioning system together with the drainage mechanism.

Figure 1:
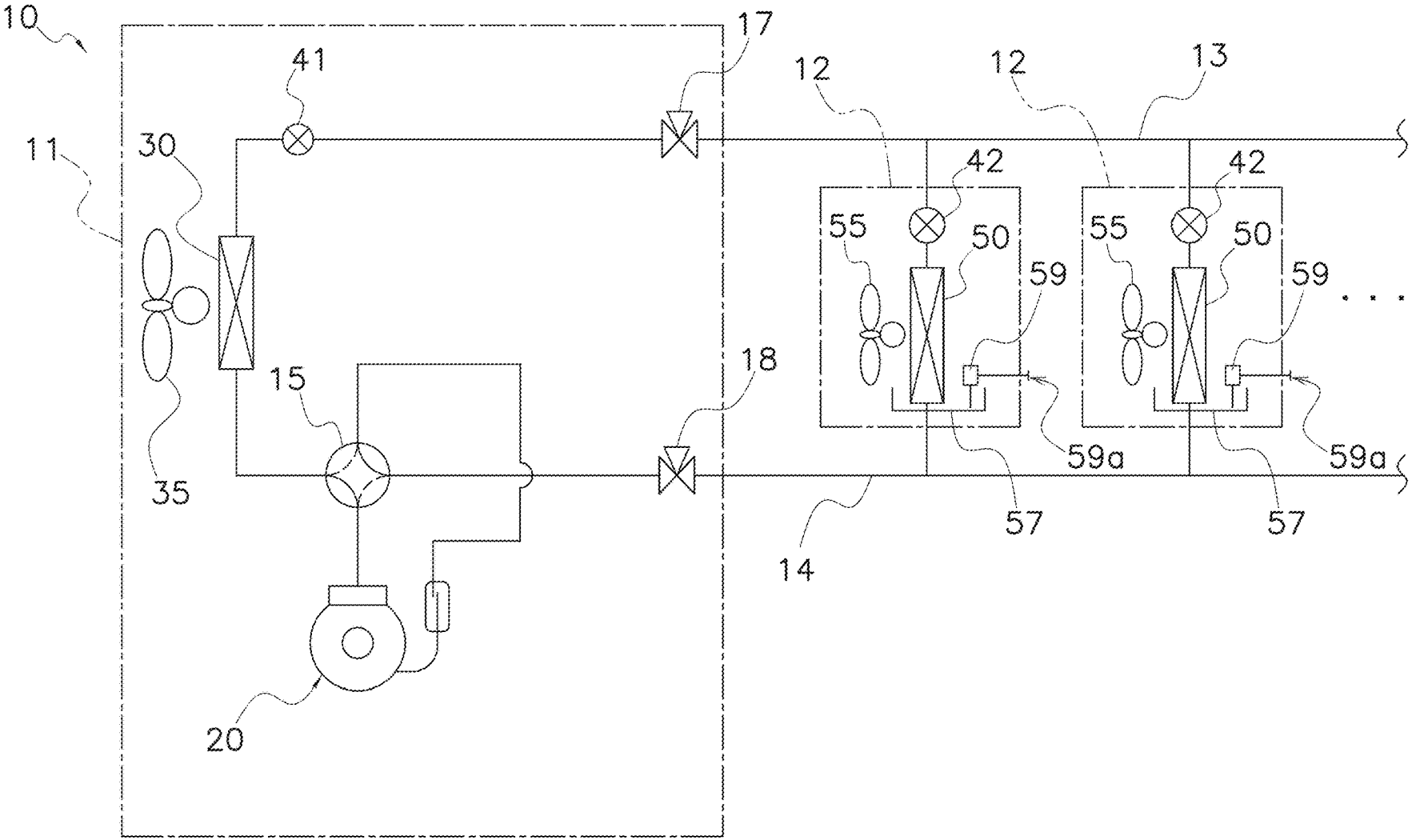

As shown in FIG. 1, the air conditioning apparatus 10 is a refrigerant pipe-scheme decentralized air conditioning apparatus, and heats and cools each room in the building by executing a vapor compression refrigeration cycle operation. The air conditioning apparatus 10 includes an air conditioning outdoor unit 11, a large number of air conditioning indoor units 12, and a liquid-refrigerant connection pipe 13 and a gas-refrigerant connection pipe 14 serving as refrigerant connection pipes connecting the air conditioning outdoor unit 11 to the air conditioning indoor units 12. A refrigerant circuit of the air conditioning apparatus 10 shown in FIG. 1 is configured by connection of the air conditioning outdoor unit 11, the air conditioning indoor units 12, and the refrigerant connection pipes 13 and 14. A refrigerant is sealed in the refrigerant circuit shown in FIG. 1. The air conditioning apparatus 10 executes the refrigeration cycle operation in which the refrigerant is compressed, cooled and condensed, decompressed, heated and evaporated, and then compressed again.

The air conditioning outdoor unit 11 is installed outside a building, in a basement of a building, or the like, and is connected to the air conditioning indoor units 12 via the refrigerant connection pipes 13 and 14. The air conditioning outdoor unit 11 mainly includes a compressor 20, a four-way switching valve 15, an outdoor heat exchanger 30, an outdoor expansion valve 41, an outdoor fan 35, a liquid-side shutoff valve 17, and a gas-side shutoff valve 18.

Figure 2:
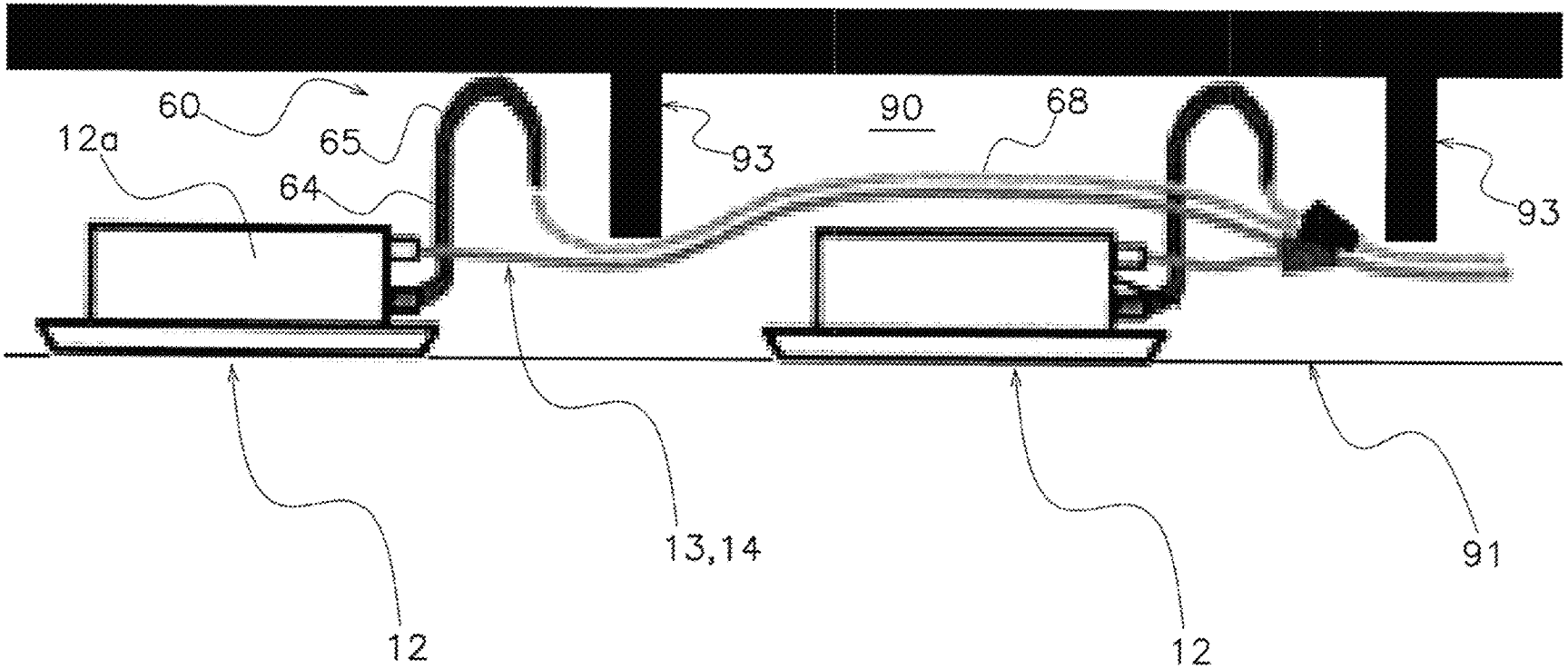
FIG. 2 is a schematic diagram showing the air conditioning indoor unit and the drainage mechanism of a first embodiment to be disposed in a space under the roof.

Each of the air conditioning indoor units 12 is installed on a ceiling 91 of each room as shown in FIG. 2, and is connected to the air conditioning outdoor unit 11 via the refrigerant connection pipes 13 and 14. The air conditioning indoor unit 12 mainly includes an indoor expansion valve 42, an indoor heat exchanger 50, an indoor fan 55, a drain pan 57, and a drain pump 59.

The indoor heat exchanger 50 is a heat exchanger that functions as a refrigerant evaporator or condenser. One end of the indoor heat exchanger 50 is connected to the indoor expansion valve 42, and the other end thereof is connected to the gas-refrigerant connection pipe 14.

During cooling operation when the indoor heat exchanger 50 functions as an evaporator, condensate is generated on a surface of the indoor heat exchanger 50. The drain pan 57 is installed to receive the condensate.

The condensate that has flowed down to the drain pan 57 is discharged by the drain pump 59 to the outside of the air conditioning indoor unit 12 as drain water. A connecting port 59*a* is provided on a discharge side of the drain pump 59. A connecting part 62*a* of a drainage mechanism 60, which will be described later, is connected to the connecting port 59*a*.

The connecting port 59*a* is a tip opening of a copper pipe protruding from a side plate of a casing 12*a* of the air conditioning indoor unit 12.

The drain pump 59 is a pump that applies pressure on the drain water and sends the drain water to the drainage mechanism 60.

The refrigerant connection pipes 13 and 14 are refrigerant pipes that will be constructed on the spot when the air conditioning outdoor unit 11 and the air conditioning indoor units 12 are installed in the building. As shown in FIG. 2, the refrigerant connection pipes 13 and 14 also pass through a space 90 under the roof in the same manner as the drainage mechanism 60 described later.

First Embodiment (1) Overall Configuration of Drainage Mechanism

Figure 3A:
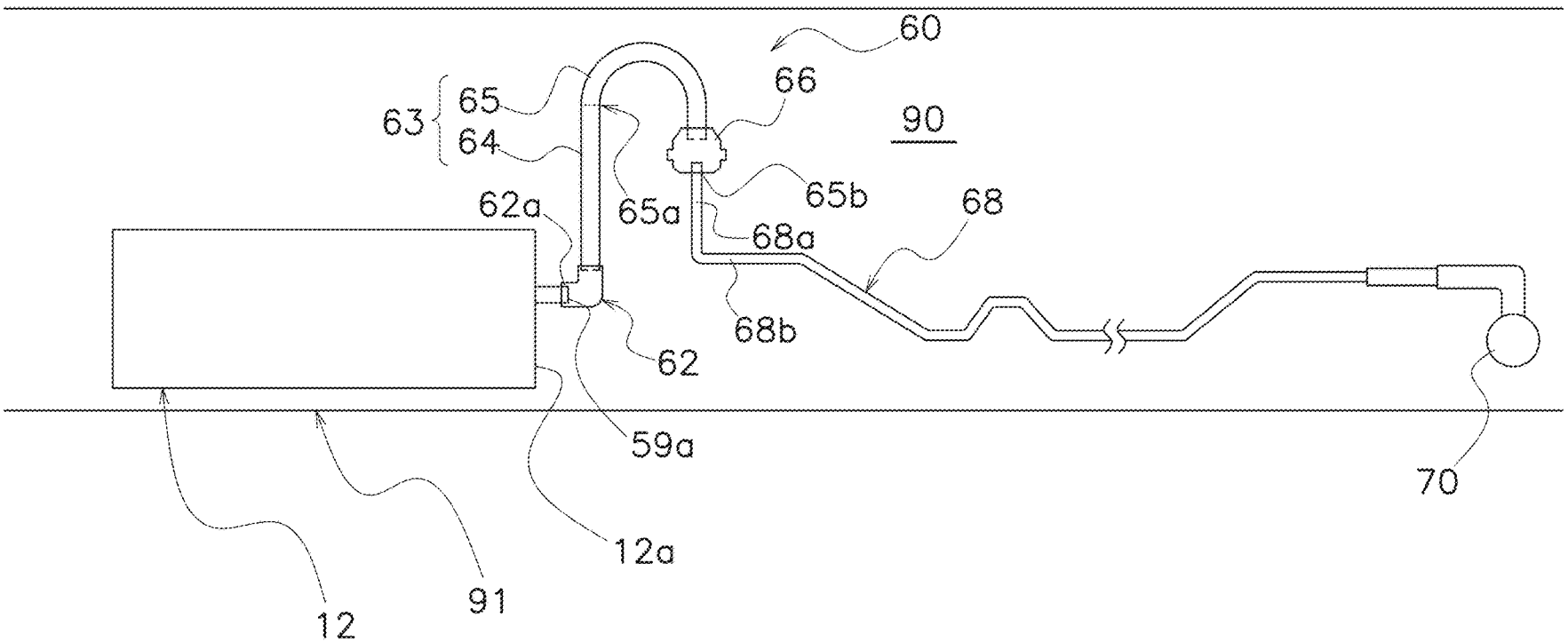
FIG. 3A is a schematic diagram of the air conditioning indoor unit and the drainage mechanism of the first embodiment.

As shown in FIG. 2 and FIG. 3A, the drainage mechanism 60 of the first embodiment is a mechanism for causing the drain water (condensate) discharged from the air conditioning indoor units 12 installed near the ceiling 91 to flow to the outside the building or in a drain ditch of the building. The drainage mechanism 60 is connected to the drain pump 59, which sucks the drain water from the drain pan 57 in the air conditioning indoor unit 12. The drainage mechanism 60 includes the connecting part 62*a* connected to the connecting port 59*a* of the drain pump 59, a first flow path 64, a folded part 65, and a second flow path 68.

Figure 3B:
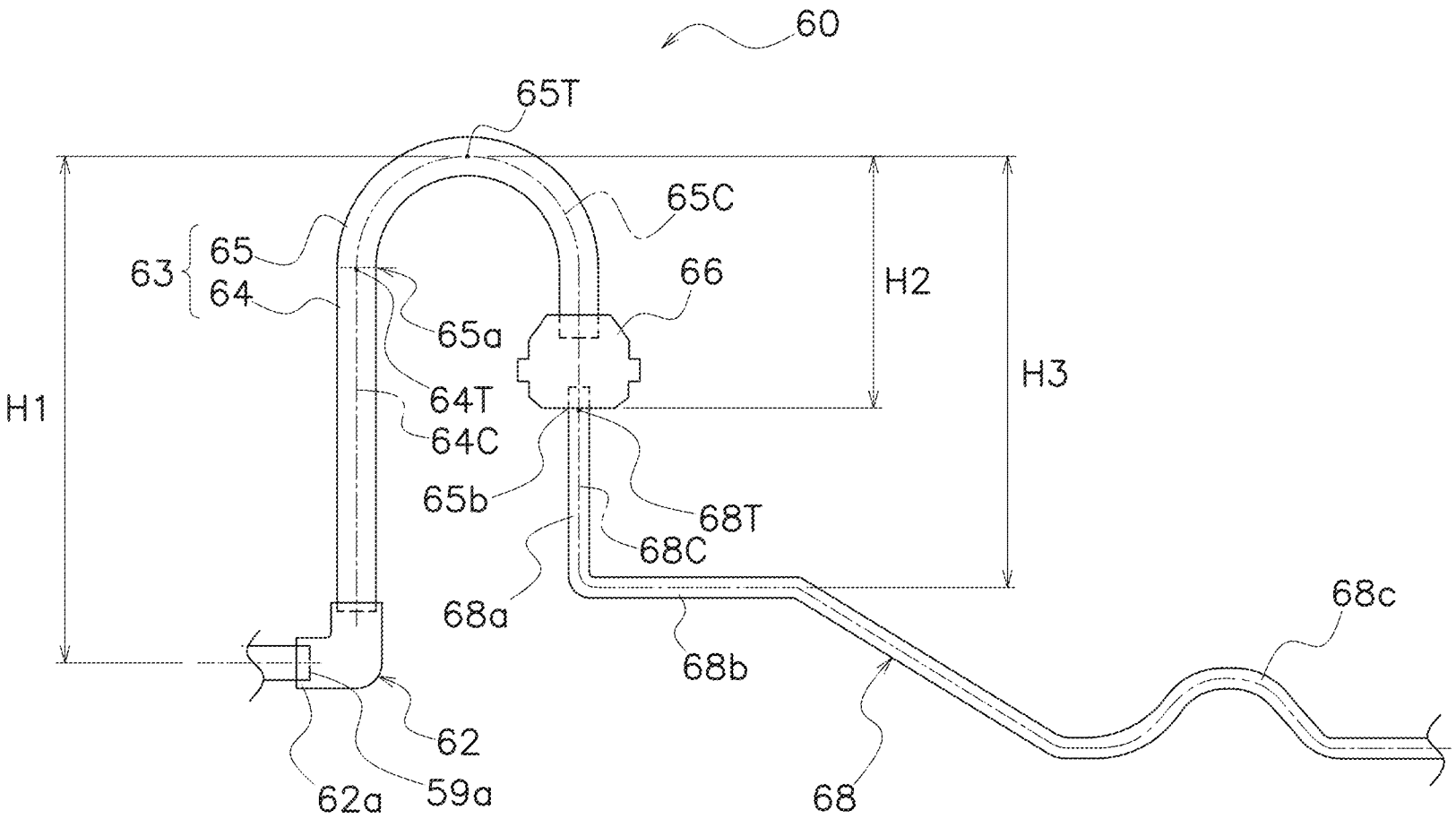
FIG. 3B is an enlarged view of the drainage mechanism shown in FIG. 3A.
Figure 4:
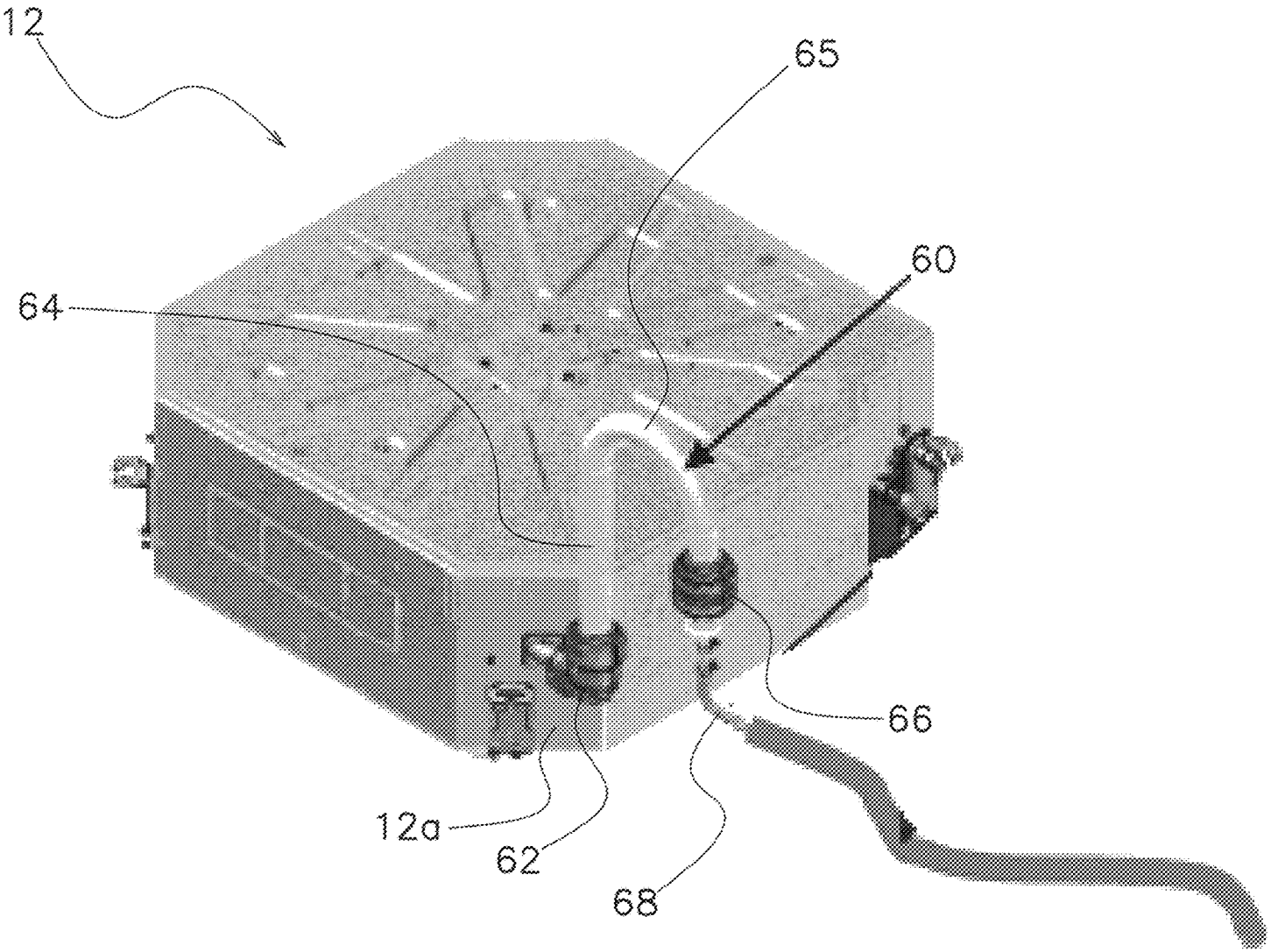
FIG. 4 is a perspective view of the air conditioning indoor unit and the drainage mechanism of the first embodiment.

(2) Detailed Configuration of Drainage Mechanism (2-1) Elbow Including Connecting Part The connecting part 62*a* of the drainage mechanism 60 is one end of an elbow 62, which is a joint, as shown in FIG. 3A and FIG. 3B. A flexible hose 63 is connected to the other upward end of the elbow 62.

(2-2) Flexible Hose in which First Flow Path and Folded Part are Integrated

The flexible hose 63 is a hose having a heat insulating function in which the first flow path 64 extending straight upward from the elbow 62 and the folded part 65 including a curved part are continuous. The folded part 65 includes a first end 65*a* connected to an upper end of the first flow path 64 and a second end 65*b* on the opposite side of the first end 65*a*. The folded part 65 changes the direction of the drain water flowing inside from upward to downward. The second end 65*b* of the folded part 65 is a connecting port at a lower end of a coupling 66 connected to the tip of the flexible hose 63. Note that in the present embodiment, the first end 65*a* is a boundary between the continuous first flow path 64 and the folded part 65.

The flow path area of the first flow path 64 of the flexible hose 63 is equal to the flow path area of the folded part 65. A flow path area of the first flow path 64 and the folded part 65 is larger than a flow path area of the second flow path 68 (copper pipe) described later. An inner diameter of the flexible hose 63 is about 19 mm.

(2-3) Copper Pipe as Second Flow Path

The second flow path 68 extending downward from the second end 65*b* of the folded part 65 is a copper pipe including a curved part 68*c*. An inner diameter of the copper pipe as the second flow path 68 is 13 mm or less. Here, as the second flow path 68, a copper pipe having an outer diameter of 12.7 mm, an inner diameter of 11.1 mm, and a wall thickness of 0.8 mm is used.

The copper pipe as the second flow path 68 is manually curved in the space 90 under the roof by an installer of the air conditioning apparatus 10 to avoid a beam 93 or the like existing in the space 90 under the roof of the building as shown in FIG. 2. The second flow path 68 is finally connected to a collecting pipe for discharge 70, which discharges the drain water to the outside of the building (see FIG. 3A), while changing the height position at each portion. Since the drain pump 59 sends the drain water under pressure, it is not necessary to install the copper pipe as the second flow path 68 in consideration of gradient.

However, since too long distance to the collecting pipe for discharge 70 will exceed the capacity of the drain pump 59, the copper pipe as the second flow path 68 may be 20 m or less long.

The copper pipe, as the second flow path 68, may include a vertical pipe portion 68*a* extending downward from the second end 65*b* and a horizontal pipe portion 68*b* extending horizontally from the vertical pipe portion 68*a*. The vertical pipe portion 68*a* may secure some length. A size H3 related to the length of the vertical pipe portion 68*a* will be described below.

(2-4) Relative Positional Relationship Between First Flow Path, Second Flow Path, and Folded Part In the drainage mechanism 60, as shown in FIG. 3B, a highest point 65T of the folded part 65 is higher than a highest point 64T of the first flow path 64, and is higher than a highest point 68T of the second flow path 68. The highest point 65T of the folded part 65 is the highest point of a center line 65C of an internal flow path of the folded part 65. The highest point 64T of the first flow path 64 is the highest point of a center line 64C of an internal flow path of the first flow path 64. The highest point 68T of the second flow path 68 is the highest point of a center line 68C of an internal flow path of the second flow path 68.

In the drainage mechanism 60, sizes H1, H2, and H3 shown in FIG. 3B are determined to be H1=200 to 500 mm H2=50 to 700 mm H3<(H1−100) mm, respectively. The size H1 is a height direction distance between the highest point 65T of the folded part 65 and the center of the connecting part 62*a*. The size H2 is a height direction distance between the highest point 65T of the folded part 65 and the second end 65*b*. The size H3 is a height direction distance between the highest point 65T of the folded part 65 and a center line of an internal flow path of the horizontal pipe portion 68*b* of the second flow path 68.

A portion beyond the horizontal pipe portion 68*b* of the copper pipe as the second flow path 68 is installed in a space lower than the height position of the horizontal pipe portion 68*b*. The copper pipe does not have to be downhill until the collecting pipe for discharge 70, but in a range from the horizontal pipe portion 68*b* to the collecting pipe for discharge 70, the copper pipe is installed in the space 90 under the roof such that the copper pipe does not rise to a space higher than the height position of the horizontal pipe portion 68*b*.

(3) Characteristics (3-1)

The drainage mechanism 60 has a configuration in which the folded part 65 is provided to change the direction of the drain water sent by the drain pump 59 under pressure from upward to downward, and the copper pipe as the second flow path 68 extends from the second end 65*b* of the folded part 65. Since the flow path area of the folded part 65 is larger than the flow path area of the second flow path 68, entrapped air is likely to be formed in the folded part 65. If entrapped air exists in the folded part 65, even if the drain pump 59 stops, the backflow of the condensate that has flowed from the first flow path 64 to the second flow path 68 via the folded part 65 is suppressed. In other words, in the drainage mechanism 60, it is unlikely that the drain water returns to the drain pan 57 of the air conditioning indoor unit 12.

Note that the entrapped air is a space filled with air in the folded part 65. The flow path area is an average of the flow path areas in respective parts when the parts are cut by a plane orthogonal to the direction of water flow. The flow path area of the second flow path 68, which is a copper pipe, is an area calculated from the inner diameter of the copper pipe.

(3-2)

In the drainage mechanism 60, the inner diameter of the copper pipe as the second flow path 68 is 13 mm or less. This copper pipe is flexible and, as shown in FIG. 2, can be constructed and installed in the space 90 under the roof while avoiding obstacles such as the beam 93.

(3-3)

In the drainage mechanism 60, the flow path area of the first flow path 64 is larger than the flow path area of the second flow path 68. Therefore, the flow path resistance until the folded part 65 is small, and the drain water flows smoothly from the drain pump 59 to the folded part 65. The risk that the flow path is clogged between the drain pump 59 and the folded part 65 is reduced. Therefore, when the flow path of the drainage mechanism 60 is clogged, only the copper pipe as the second flow path 68 needs maintenance.

(3-4)

The drainage mechanism 60 adopts the flexible hose 63, in which the first flow path 64 and the folded part 65 are integrated. This can reduce the number of parts. This also simplifies the construction work. There is also a merit of cost reduction in terms of parts procurement cost and construction cost.

(3-5)

In the drainage mechanism 60, the highest point 65T of the folded part 65 is placed at a position 200 mm or more higher than the connecting part 62*a* connected to the drain pump 59. This suppresses the backflow of the drain water from the second flow path 68 to the first flow path 64 more reliably.

In the drainage mechanism 60, the height of the highest point 65T of the folded part 65 is set to be 500 mm higher than the connecting part 62*a*, or is set to be lower than the position 500 mm higher than the connecting part 62*a*. In this way, since the height of the folded part 65 is not unnecessarily increased, the capacity of the drain pump 59 can be suppressed.

(3-6)

In the drainage mechanism 60, the height direction distance between the highest point 65T of the folded part 65 and the second end 65*b* (size H2) is 50 to 700 mm.

Here, the size H2 is secured at 50 mm or more. This suppresses the backflow of the drain water from the second flow path 68 to the first flow path 64 more reliably.

Here, the size H2 is set to 700 mm or less. This prevents the constraint on the installation of the second flow path 68 extending from the second end 65*b* from becoming too large. If the height position of the second end 65*b* becomes low, it becomes difficult to install the second flow path 68.

(4) Modifications (4-1) Modification 1A

The drainage mechanism 60 of the first embodiment adopts the copper pipe as the second flow path 68. Instead of the copper pipe, another metal pipe or a resin pipe may be adopted.

For example, as the second flow path 68, a flexible hose smaller than the flexible hose 63 in flow path area may be adopted and installed while avoiding obstacles. As the second flow path 68, a polyvinyl chloride pipe and joint can also be adopted. Even if these pipes are adopted as the second flow path 68, the second flow path 68 can be easily laid even in the narrow space 90 under the roof with many obstacles.

(4-2) Modification 1B

The drainage mechanism 60 of the first embodiment uses the elbow 62 and the coupling 66, but one end of the flexible hose 63 may be directly connected to the connecting port 59*a* of the drain pump 59, or the second flow path 68 may be directly connected to the other end of the flexible hose 63.

(4-3) Modification 1C

The drainage mechanism 60 of the first embodiment is a mechanism for causing the drain water (condensate) discharged from the air conditioning indoor units 12 installed near the ceiling 91 to flow to the outside a building or in a drain ditch of the building. Meanwhile, the drainage mechanism 60 can also be adopted as a mechanism that causes excess water discharged from a humidifier installed near the ceiling to flow to the outside of the building.

(4-4) Modification 1D

In the drainage mechanism 60 of the first embodiment, a portion beyond the horizontal pipe portion 68*b* of the copper pipe as the second flow path 68 is installed in a space lower than the height position of the horizontal pipe portion 68*b*. However, the horizontal pipe portion 68*b* may or may not be installed.

In the drainage mechanism 60 of the first embodiment, in a range from the horizontal pipe portion 68*b* to the collecting pipe for discharge 70, the copper pipe is installed in the space 90 under the roof such that the copper pipe does not rise to a space higher than the height position of the horizontal pipe portion 68*b*. However, even if the copper pipe rises to a space higher than the height position of the horizontal pipe portion 68*b* in order to avoid obstacles, or the like, if part of the copper pipe as the second flow path 68 passes through a lower position of the space 90 under the roof, drain water returning to the drain pan 57 of the air conditioning indoor unit 12 can be suppressed.

Second Embodiment (1) Overall Configuration of Drainage Mechanism

Figure 5:
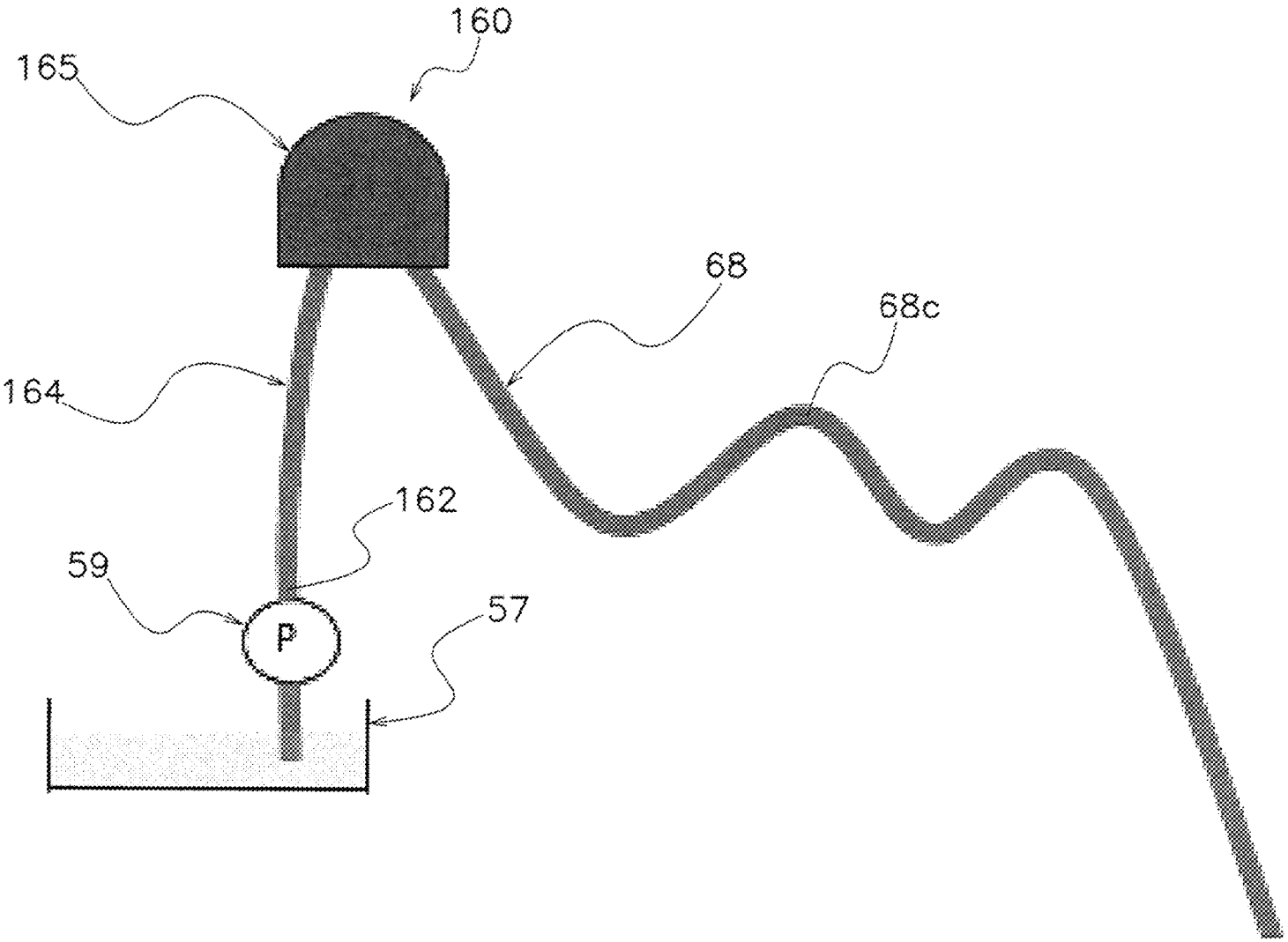
FIG. 5 is a schematic diagram of a drainage mechanism of a second embodiment.

The drainage mechanism 60 of the first embodiment adopts the flexible hose 63 in which the first flow path 64 and the folded part 65 are integrated. Instead, a drainage mechanism 160 may adopt a container 165 and a copper pipe as a first flow path 164 shown in FIG. 5 and FIG. 6.

The drainage mechanism 160 includes a copper pipe as a connecting part 162 and the first flow path 164 connected to a drain pump 59, the container 165 functioning as a folded part, and a copper pipe as a second flow path 68.

(2) Detailed Configuration of Drainage Mechanism (2-1) Connecting Part, First Flow Path, and Second Flow Path The copper pipe as the connecting part 162 and the first flow path 164, and the copper pipe as the second flow path 68 have the same size. The copper pipe as the first flow path 164 extends from a connecting port of the drain pump 59 toward the container 165 located above. A lower end of the copper pipe as the first flow path 164 is the connecting part 162 connected to the drain pump 59. The copper pipe as the second flow path 68 is the copper pipe similar to the copper pipe in the first embodiment.

(2-2) Container

Figure 6:
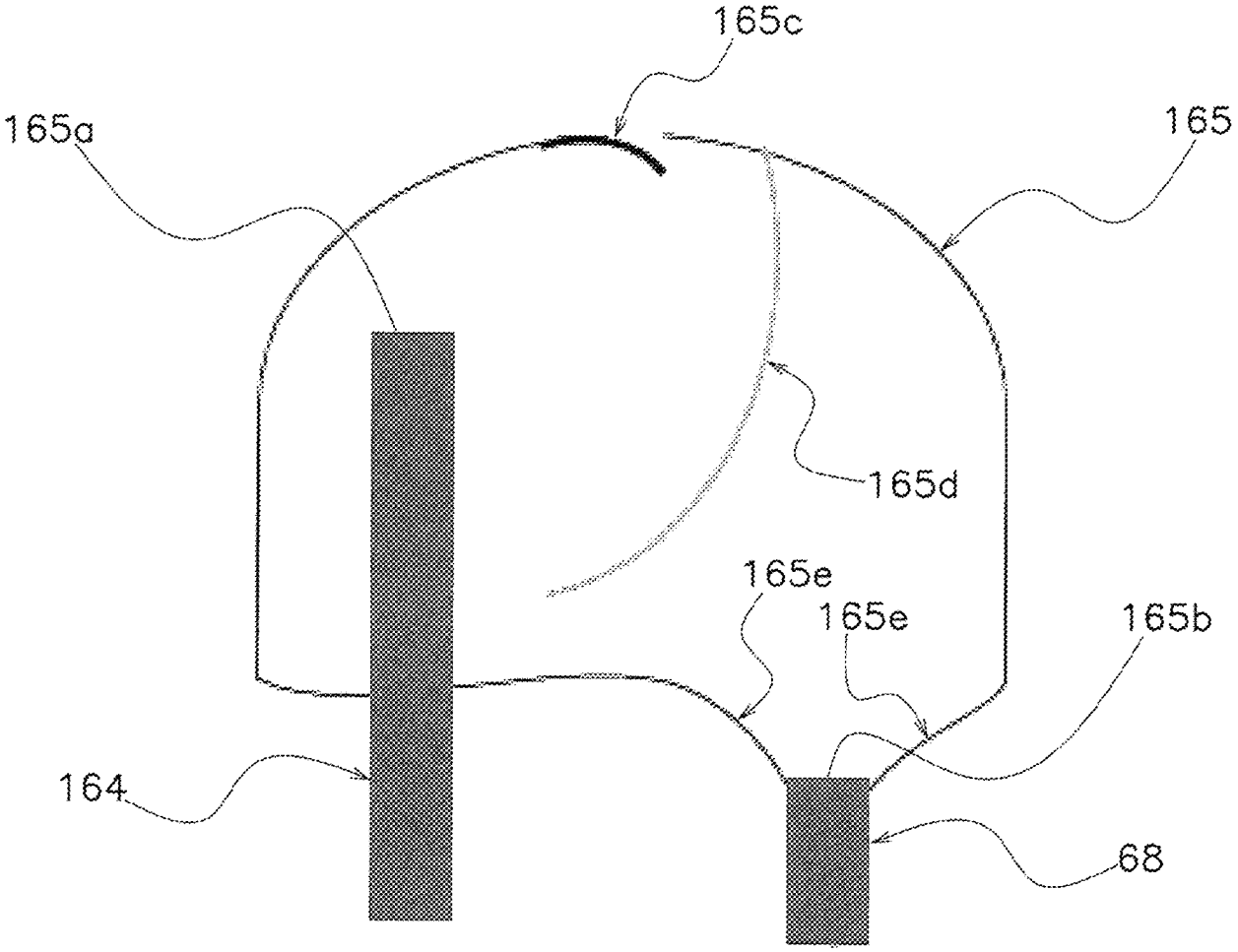
FIG. 6 is a schematic diagram of a container of the drainage mechanism of the second embodiment.

The container 165 is made of a soft material such as rubber to prevent the sound from reverberating. The container 165 plays a role of causing drain water to flow from the first flow path 164 to the second flow path 68 between the copper pipe as the first flow path 164 and the copper pipe as the second flow path 68, as shown in FIG. 6. A flow path area of the container 165 is larger than a flow path area of the first flow path 164 and the second flow path 68. An upper end of the copper pipe as the first flow path 164 inserted into the container 165 is a first end 165*a* of the container 165. The upper end of the copper pipe as the first flow path 164 is at a position higher than an upper end of the copper pipe as the second flow path 68, suppressing the backflow of the drain water. The upper end of the copper pipe as the second flow path 68 inserted into the container 165 is a second end 165*b* of the container 165.

Note that the flow path area of the container 165 refers to the area inside the container 165 when the container 165 is cut by a plane orthogonal to the flow direction of the drain water flowing from the first end 165*a* to the second end 165*b*. As shown in FIG. 6, the area inside the container 165 is different between when cut near the first end 165*a* and when cut near the second end 165*b*. Here, an average of areas inside the container 165 when cut by planes orthogonal to the flow direction of the drain water in the container 165 is defined as the flow path area of the container 165.

The container 165 includes a switching member 165*c*. The switching member 165*c* is a flexible rubber member and switches between the communication state and non-communication state of an internal space of the container 165 and an external space of the container 165. When the pressure of the internal space of the container 165 drops to less than a predetermined value, the switching member 165*c* switches from the non-communication state to the communication state to take in air in the external space of the container 165 into the internal space of the container 165. The switching member 165*c* shown in FIG. 6 is in the communication state. Note that when the drain pump 59 is operating and the pressure of the internal space of the container 165 is high, the rubber switching member 165*c* is in the non-communication state, and the gap above the switching member 165*c* in FIG. 6 is closed.

The container 165 includes a silencing member 165*d*. The silencing member 165*d* suppresses sound propagation between the first flow path 164 and the second flow path 68. The silencing member 165*d* is curved in the opposite direction of a sound source, and has a high silencing effect.

An inclined portion 165*e* is formed around the second end 165*b* of the container 165. The inclined portion 165*e* of the container 165 is gently inclined to prevent the drain water from accumulating.

(3) Characteristics (3-1)

The drainage mechanism 160 adopts the container 165 as the folded part instead of a pipe. Therefore, the flow path area and the internal volume of the container 165 as the folded part are large. This causes large entrapped air to be generated in the internal space of the container 165 that functions as the folded part. This suppresses the backflow of the condensate that has flown from the first flow path 164 to the second flow path 68 via the container 165.

(3-2)

The drainage mechanism 160 adopts the first flow path 164 (copper pipe) having a smaller flow path area than the container 165 functioning as the folded part. Therefore, bending the copper pipe as the first flow path 164 makes it possible to install the container 165 at a location away from an air conditioning indoor unit 12.

(3-3)

In the drainage mechanism 160, the container 165 includes the switching member 165*c*. Therefore, even if the drain pump 59 stops and the internal pressure of the container 165 drops, when the pressure drops to a predetermined value or less, the switching member 165*c* switches from the non-communication state to the communication state. This causes the air in the external space of the container 165 to be taken into the internal space of the container 165, increasing the pressure inside the container 165. Therefore, in the drainage mechanism 160, the phenomenon that the drain water flows backward due to the pressure drop in the entrapped air inside the container 165 is less likely to occur.

(3-4)

In the drainage mechanism 160, the container 165 includes the silencing member 165*d*. In the drainage mechanism 160, there is a risk of abnormal noise when the drain water passes under the influence of the entrapped air in the container 165, but the container 165 includes the silencing member 165*d*, thereby making it possible to suppress the phenomenon of loud noise leaking into the space where the air conditioning indoor unit 12 is installed.

(4) Modifications (4-1) Modification 2A

Figure 7A:
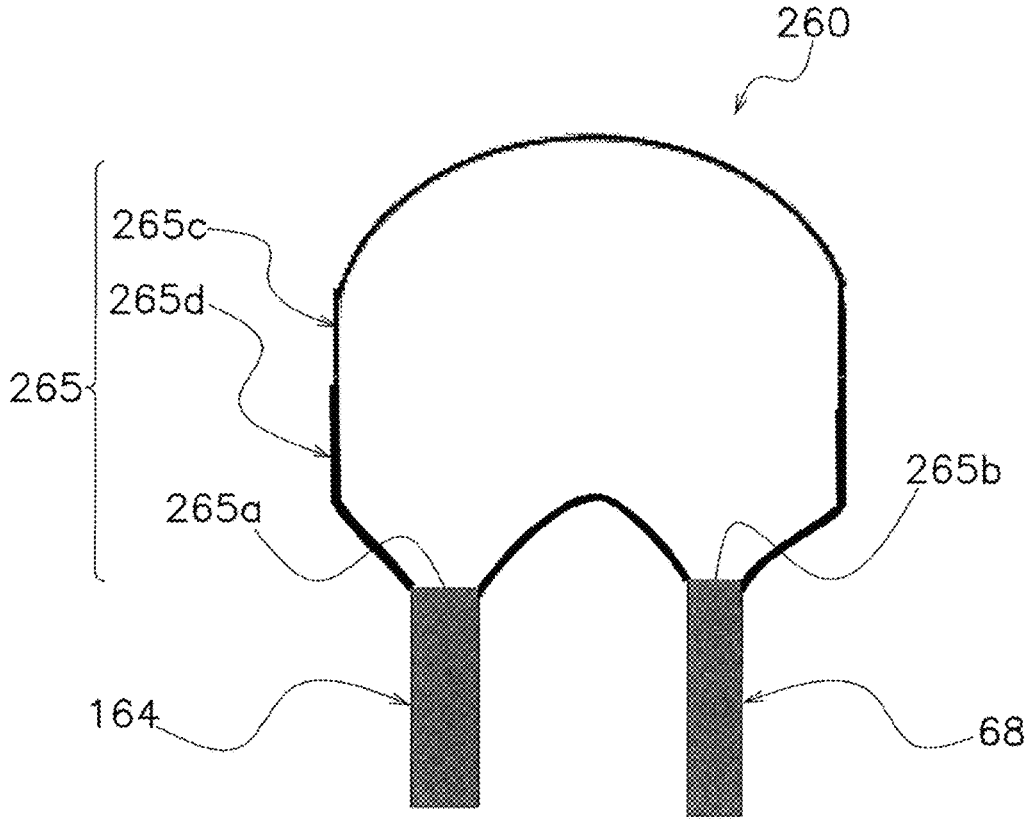
FIG. 7A is a schematic diagram showing one state of the container of the drainage mechanism of modification 2A of the second embodiment.

In the drainage mechanism 160 of the second embodiment, the container 165 is disposed between the first flow path 164 and the second flow path 68. Instead, a drainage mechanism 260 may adopt a container 265 shown in FIG. 7A and FIG. 7B.

The drainage mechanism 260 is a drainage mechanism that adopts the container 265 instead of the container 165 of the drainage mechanism 160. The container 265 includes a less rigid rubber upper portion 265*c* and a more rigid lower portion 265*d*. At a lower end of the lower portion 265*d*, two connecting ports are formed, a first end 265*a* to which a copper pipe as the first flow path 164 is connected, and a second end 265*b* to which a copper pipe as the second flow path 68 is connected.

Figure 7B:
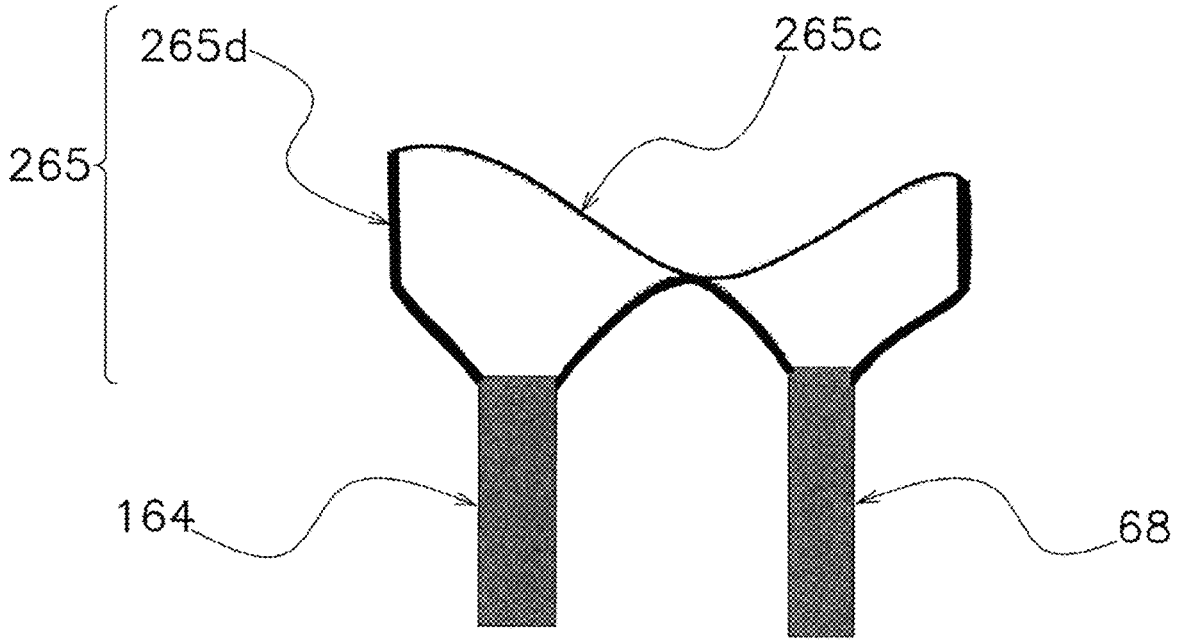
FIG. 7B is a schematic diagram showing another state of the container of the drainage mechanism of modification 2A of the second embodiment.

The upper portion 265*c* of the container 265 closes the internal flow path of the container 265 by elastic deformation thereof, as shown in FIG. 7B. With this configuration, even if the drain pump 59 stops and the internal pressure of the container 265 drops, the shape of the container 265 changes to close the internal flow path. Therefore, the drainage mechanism 260 can also suppress the phenomenon that the drain water flows backward from the second flow path 68 to the first flow path 164 via the container 265.

(4-2) Modification 2B

The drainage mechanism 160 of the second embodiment adopts the container 165 including a soft material such as rubber. Instead, the entire container may include a highly rigid material such as resin or metal.

Third Embodiment (1) Overall Configuration of Drainage Mechanism

Figure 8:
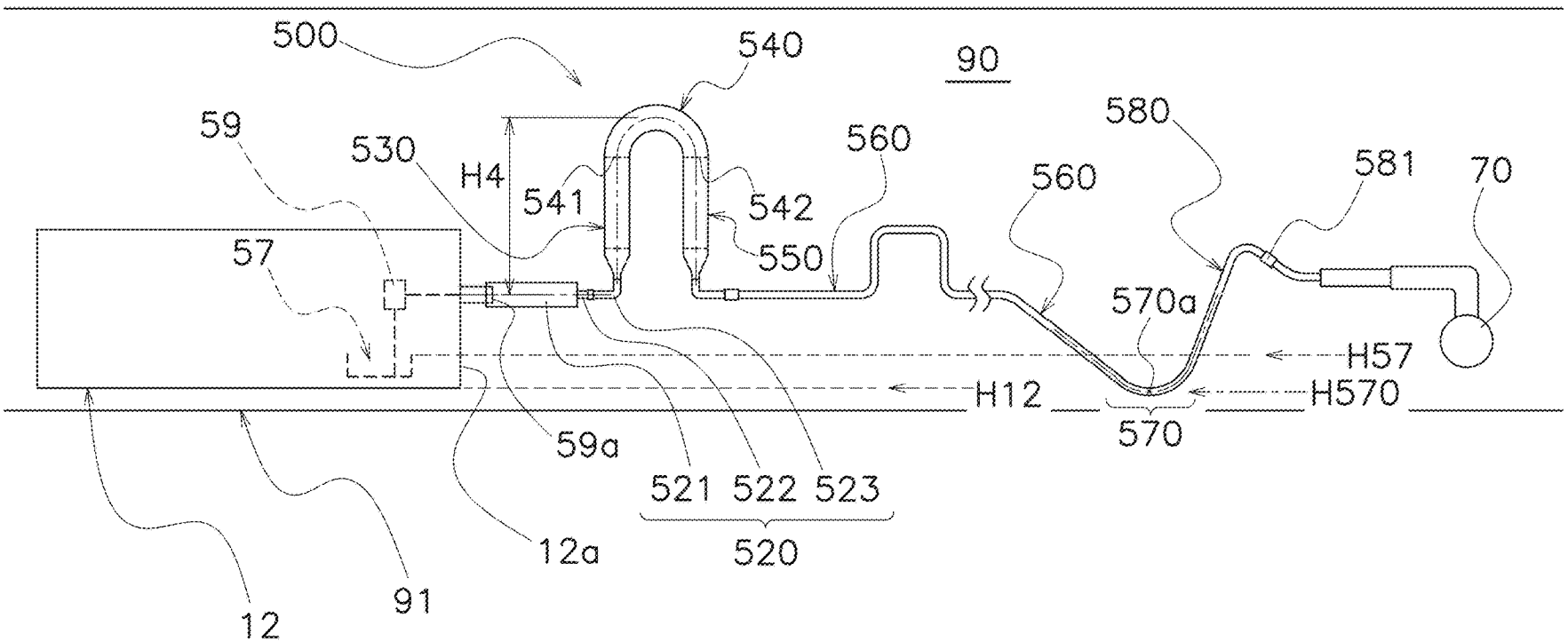
FIG. 8 is a schematic diagram of an air conditioning indoor unit and a drainage mechanism of a third embodiment.

As shown in FIG. 8, a drainage mechanism 500 of the third embodiment is a mechanism for causing drain water (condensate) discharged from an air conditioning indoor unit 12 installed near a ceiling 91 to flow to the outside a building or in a drain ditch of the building. The drainage mechanism 500 is connected to a drain pump 59, which sucks the drain water from a drain pan 57 in the air conditioning indoor unit 12. The drainage mechanism 500 includes a connecting part 520 connected to a connecting port 59*a* of the drain pump 59, a first flow path 530, a second flow path 540, a third flow path 550, a fourth flow path 560, a fifth flow path 570, and an sixth flow path 580.

(2) Detailed Configuration of Drainage Mechanism (2-1) Connecting Part

The connecting part 520 of the drainage mechanism 500 mainly includes a polyvinyl chloride pipe 521 fitted into the connecting port 59*a* of the drain pump 59, a small-diameter copper pipe 522 connected to the polyvinyl chloride pipe 521, and an elbow 523 that forms flared connection to the small-diameter copper pipe 522. The small-diameter copper pipe 522 is a copper pipe having an outer diameter of 9.52 mm and a wall thickness of 0.8 mm. In this specification, the copper pipe having these outer diameter and wall thickness is referred to as small-diameter copper pipe. The small-diameter copper pipe is a copper pipe with a nominal diameter (JRA) of sanbu in Japan. The inner diameter of the small-diameter copper pipe is about 7.9 mm. The elbow 523 is also a copper joint having an outer diameter of 9.52 mm and a wall thickness of 0.8 mm.

(2-2) U-Shaped Large-Diameter Copper Pipe as First Flow Path, Second Flow Path, and Third Flow Path The U-shaped first flow path 530, the second flow path 540, and the third flow path 550 shown in FIG. 8 are one large-diameter copper pipe. The U-shaped large-diameter copper pipe is a copper pipe having an outer diameter of 22.22 mm and a wall thickness of about 1 mm. In this specification, the copper pipe having these outer diameter and wall thickness is referred to as large-diameter copper pipe. The large-diameter copper pipe is a copper pipe with a nominal diameter (JRA) of nanabu in Japan. An inner diameter of the large-diameter copper pipe is about 20 mm.

The first flow path 530 is a part of the U-shaped large-diameter copper pipe extending upward from the connecting part 520. The second flow path 540 is a part of the U-shaped large-diameter copper pipe that changes the direction of water flowing inside from upward to downward. The second flow path 540 includes a first end 541 and a second end 542. The first end 541 is connected to an upper end of the first flow path 530. The second end 542 is located on the opposite side of the first end 541. The third flow path 550 is a part of the U-shaped large-diameter copper pipe extending downward from the second end 542 of the second flow path 540.

A height direction distance H4 of 200 mm or more may be secured between a highest point of a center line of an internal flow path of the second flow path 540 and the connecting port 59*a* of the drain pump 59 to which the connecting part 520 is connected (see FIG. 8). Here, the drainage mechanism 500 is installed such that the distance H4 is 250 to 500 mm.

(2-3) Small-Diameter Copper Pipe as Fourth Flow Path, Fifth Flow Path, and Sixth Flow Path The copper pipe as the fourth flow path 560, the fifth flow path 570, and the sixth flow path 580 is the above-described small-diameter copper pipe. The fourth flow path 560, the fifth flow path 570, and the sixth flow path 580 including one or more small-diameter copper pipes are manually curved in a space 90 under the roof by an installer to avoid a beam or the like existing in the space 90 under the roof of the building. The fourth flow path 560, the fifth flow path 570, and the sixth flow path 580 are finally connected to a collecting pipe for discharge 70, which discharges the drain water to the outside of the building, while changing the height position at each portion. Since the drain pump 59 sends the drain water under pressure, it is not necessary to install the small-diameter copper pipe as the fourth flow path 560, the fifth flow path 570, and the sixth flow path 580 in consideration of gradient.

The fourth flow path 560 extends from a lower part of the third flow path 550. A flow path area of the fourth flow path 560, which is a small-diameter copper pipe, is about 49 $mm^2$ because the inner diameter is 7.9 mm. Meanwhile, the flow path area of the large-diameter copper pipe including the second flow path 540 and the third flow path 550 is about 314 $mm^2$ because the inner diameter is about 20 mm. The inner diameter of the second flow path 540 and the third flow path 550 is about 20 mm, which is larger than the inner diameter of the fourth flow path of 7.9 mm, and is about 2.5 times the inner diameter of the fourth flow path of 7.9 mm.

The fifth flow path 570 is part of the small-diameter copper pipe that is continuous with the fourth flow path 560. The fifth flow path 570 is located between the fourth flow path 560 and the sixth flow path 580. As shown in FIG. 8, a height position H570 of a lowest point 570*a* having the lowest height out of a center line of an internal flow path of the fifth flow path 570 is lower than any point of a center line of an internal flow path of the fourth flow path 560. The height position H570 of the lowest point 570*a* of the fifth flow path 570 is lower than a height position H57 of an upper end of the drain pan 57.

A height position of any point of a center line of an internal flow path of the sixth flow path 580 is, as shown in FIG. 8, higher than the height position H570 of the lowest point 570*a* of the fifth flow path 570. The sixth flow path 580 is located between the collecting pipe for discharge 70 that discharges the drain water to the outside of the building and the fifth flow path 570. In other words, the lowest point 570*a* of the fifth flow path 570 is the lowest point out of the center line of the internal flow path of the small-diameter copper pipe extending from a lower part of the third flow path 550 (fourth flow path 560, fifth flow path 570, and sixth flow path 580). The sixth flow path 580 is connected to a branch pipe extending from the collecting pipe for discharge 70 via a flare connecting part 581. The sixth flow path 580 may be 2 to 4 m long.

(3) Characteristics (3-1)

In the drainage mechanism 500, the fourth flow path 560 and the like is a small-diameter copper pipe, and therefore is flexible. This makes it easy to construct and install the fourth flow path 560, the fifth flow path 570, and the sixth flow path 580 while avoiding obstacles in the space 90 under the roof.

Meanwhile, the fourth flow path 560, the fifth flow path 570, and the sixth flow path 580, which are a small-diameter copper pipe having an inner diameter of 7.9 mm and a flow path area of about 49 $mm^2$, are often filled (sealed) with the drain water. In the time zone when a lot of drain water is generated, in particular, the drain water continues to be sent under pressure, with the fourth flow path 560, the fifth flow path 570, and the sixth flow path 580 filled with the drain water. In such a state, it is assumed that when the drain pump 59 stops, the water that has flowed from the first flow path 530 to the fourth flow path 560 will flow backward.

In view of this, the drainage mechanism 500 has a configuration in which the second flow path 540 is provided to change the direction of the drain water that is sent under pressure by the drain pump 59 from upward to downward, the third flow path 550 extends downward from the second end 542 of the second flow path 540, and the fourth flow path 560 further extends from the third flow path 550. Since the flow path area of the second flow path 540 and the third flow path 550 (about 314 $mm^2$) is larger than the flow path area of the fourth flow path 560 (about 49 $mm^2$), entrapped air is formed in at least one of the second flow path 540 and the third flow path 550. If the entrapped air exists in the second flow path 540 and/or the third flow path 550, even if the drain pump 59 stops, the backflow of water that has flowed from the first flow path 530 to the fourth flow path 560 is suppressed. In other words, in the drainage mechanism 500, the phenomenon that the drain water returns to the drain pan 57 of the air conditioning indoor unit 12 is unlikely to occur.

Note that in the drainage mechanism 500, when the drain pump 59 causes the drain water to flow at a flow rate of 800 cc/min, entrapped air of about 50 cc is generated from the second flow path 540 to the third flow path 550. The entrapped air is a space filled with air in the second flow path 540 and the third flow path 550.

(3-2)

The drainage mechanism 500 is provided with the fifth flow path 570 having the center line including the lowest point 570*a* with the height position lower than the height position H57 of the upper end of the drain pan 57. In other words, when the small-diameter copper pipe (the fourth flow path 560, the fifth flow path 570, the sixth flow path 580) extending from the U-shaped large-diameter copper pipe toward the collecting pipe for discharge 70 is laid under the roof, a trap is made such that part of the small diameter pipe is lower than the height position H57 of the upper end of the drain pan 57. As shown in FIG. 8, the fifth flow path 570 acts as the so-called trap.

Since the fifth flow path 570 is provided, even if the drain pump 59 stops, some of the water in the connecting part 520 or the first flow path 530 falls to the drain pan 57 side, and the entrapped air in the second flow path 540 or the third flow path 550 moves a little to the drain pan 57 side, it is possible to secure a sufficient height direction distance between the entrapped air and the lowest point 570*a* of the fifth flow path 570. This makes it possible to prevent the phenomenon that the water existing in the small-diameter copper pipe (the fourth flow path 560, the fifth flow path 570, the sixth flow path 580) also flows backward to the drain pan 57.

Note that in the drainage mechanism 500, the small-diameter copper pipe (the fourth flow path 560, the fifth flow path 570, the sixth flow path 580) is laid such that the height position H570 of the lowest point 570*a* of the fifth flow path 570 is lower than the height position H57 of the upper end of the drain pan 57. However, it can be difficult to recognize the height position H57 of the upper end of the drain pan 57 from outside the air conditioning indoor unit 12. The height direction distance between the entrapped air in the U-shaped large-diameter pipe and the lowest point 570*a* of the fifth flow path 570 may be set as large as possible. Therefore, the lowest point 570*a* of the fifth flow path 570 may be lowered to a position lower than the height position of the lower end of the drain pan 57, furthermore to a position lower than the height position of a lower surface of the air conditioning indoor unit 12.

(4) Modifications (4-1) Modification 3A

In the drainage mechanism 500 of the third embodiment, the first flow path 530, the second flow path 540, and the third flow path 550 are formed by the U-shaped large-diameter copper pipe. Instead, only the second flow path 540 and the third flow path 550 may be formed by the large-diameter copper pipe and the first flow path 530 may be formed by the small-diameter copper pipe. In this case as well, entrapped air is formed in at least one of the second flow path 540 and the third flow path 550, suppressing the backflow of water from the fourth flow path 560.

(4-2) Modification 3B

In the drainage mechanism 500 of the third embodiment, the sixth flow path 580 is provided between the fifth flow path 570 including the lowest point 570*a* and the collecting pipe for discharge 70. The sixth flow path 580 extends diagonally upward from the fifth flow path 570, as shown in FIG. 8. Instead of such a configuration, a configuration may be adopted in which the fifth flow path 570 extends horizontally long from the lowest point 570*a* and is connected to the collecting pipe for discharge 70.

(4-3) Modification 3C

In the drainage mechanism 500 of the third embodiment, the size of the drain pan 57 of the air conditioning indoor unit 12 is not mentioned. The relationship between the size of the drain pan 57 and the size of the drain pump 59 and the connecting part 520 to the second flow path 540 of the drainage mechanism 500 may be a magnitude relationship described below.

Figure 9:
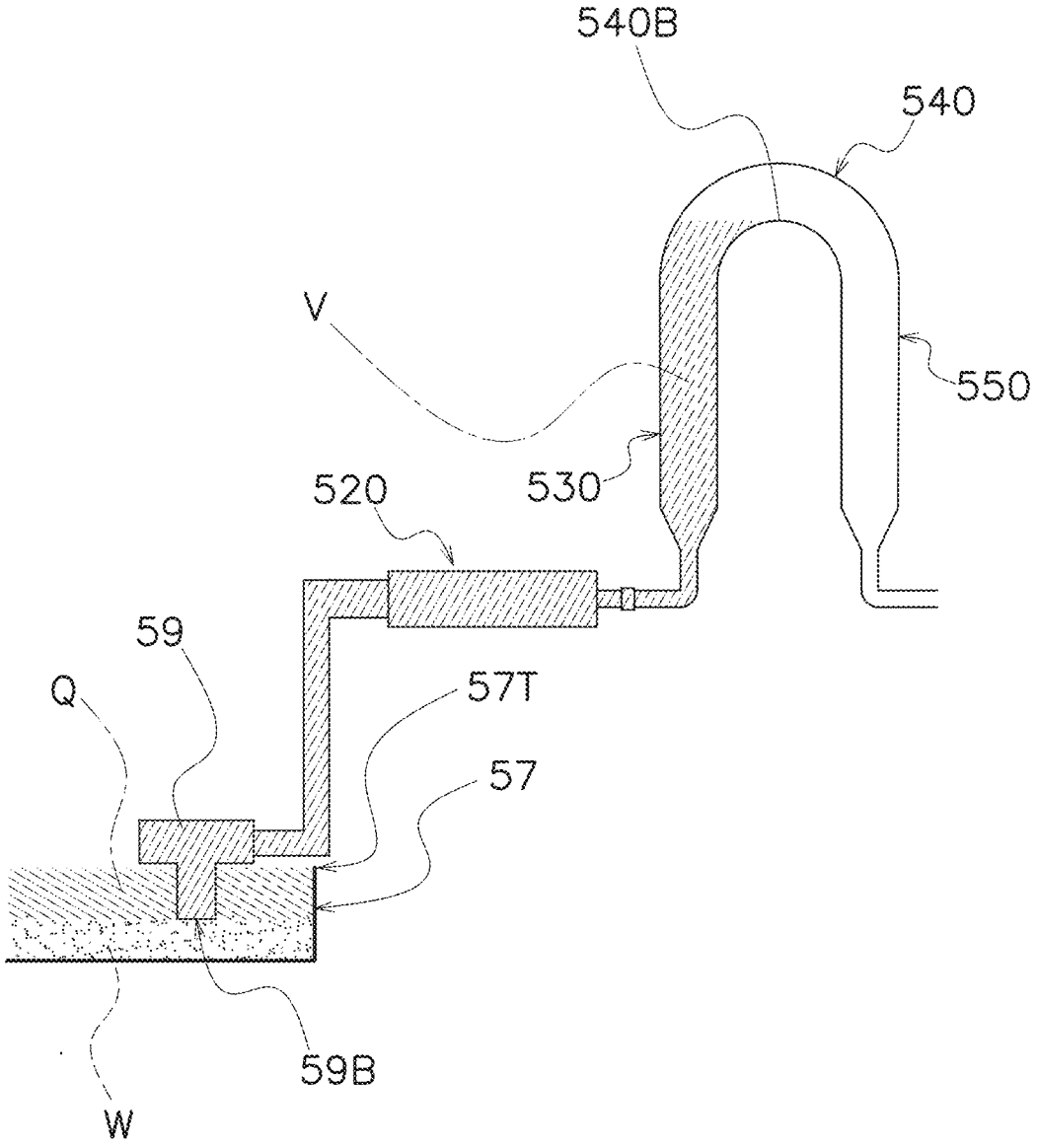
FIG. 9 is a schematic diagram of the drainage mechanism of modification 3C of the third embodiment.

As shown in FIG. 9, out of the internal volume of the drain pan 57, the volume of a portion located above the height position of a drain suction port 59B of the drain pump 59 and below the height position of an upper end 57T of a side wall of the drain pan 57 is defined as volume Q. Normally, when the drain pump 59 is operating, the drain suction port 59B of the drain pump 59 indicates the water level of the drain pan 57. Therefore, it can be said that the volume Q is a volume of a space of the internal space of the drain pan 57 that contains no drain water and is open to the atmosphere. It can be said that the volume Q is the maximum volume that can hold the backflow drain water in the drain pan 57 when the drain water flows backward from the drainage mechanism 500 and returns to the drain pan 57.

This volume Q exceeds the volume V shown in FIG. 9 in modification 3C. Conversely, the sizes of the drain pump 59 and the connecting part 520 to the second flow path 540 of the drainage mechanism 500 are determined such that the volume Q exceeds the volume V. The volume V is the total volume of the internal volume of the drain pump 59, the internal volume of the connecting part 520 of the drainage mechanism 500, the internal volume of the first flow path 530, and the volume of a portion that is lower than the height position of the top (highest point) of a flow path lower surface 540B of the second flow path 540 and continuous with the first flow path 530, out of the internal volume of the second flow path 540.

With the configuration of modification 3C, even if the drain pump 59 breaks down and the drain water in the space indicated by the volume V in FIG. 9 flows backward from the drainage mechanism 500 and the drain pump 59 and returns to the drain pan 57, the drain water does not overflow from the drain pan 57. With the configuration of modification 3C, even if a drain pump without a built-in check valve is used as the drain pump 59, the drain water will not overflow from the drain pan 57 due to the drain water flowing backward from the drainage mechanism 500 and the drain pump 59 when the drain pump 59 stops.

(4-4) Modification 3D

In the drainage mechanism 500 of the third embodiment, the first flow path 530, the second flow path 540, and the third flow path 550 are formed by the U-shaped large-diameter copper pipe. Instead, a drainage mechanism 600 that adopts a first flow path 630, a second flow path 640, and a third flow path 650 shown in FIG. 10 may be connected to the drain pump 59. In the drainage mechanism 600 shown in FIG. 10, in a similar manner to modification 3C described above, out of the internal volume of the drain pan 57, the volume of a portion located above the water level of the drain pan 57 when the drain pump 59 is operating (height position of drain suction port 59B of drain pump 59) and located below the height position of the upper end 57T of the side wall of the drain pan 57 is defined as volume Q.

Figure 10:
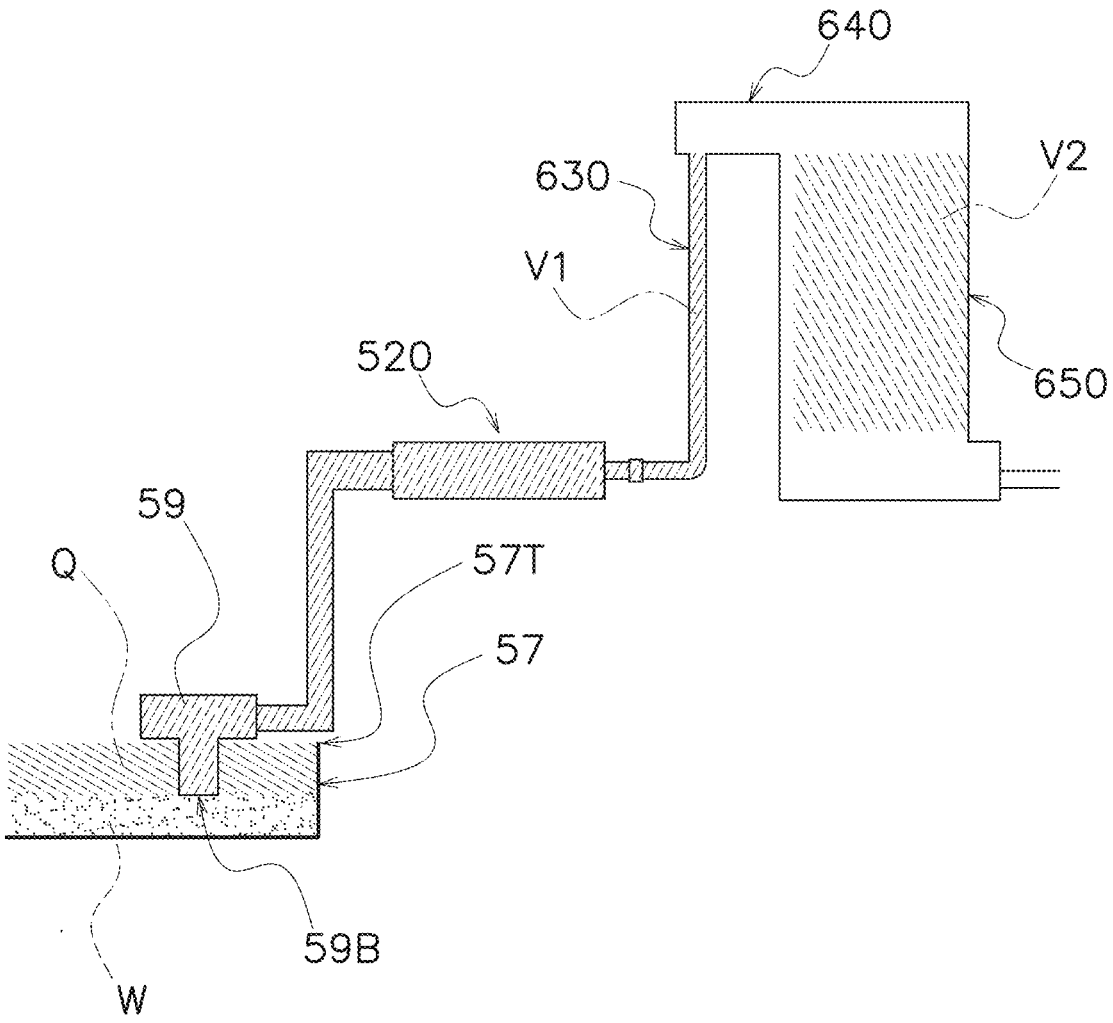
FIG. 10 is a schematic diagram of the drainage mechanism of modification 3D of the third embodiment.

The volume Q exceeds the volume V1 shown in FIG. 10 in modification 3D. Conversely, the sizes of the drain pump 59 and the connecting part 520 to the first flow path 630 of the drainage mechanism 600 and the shape of a connecting part 640 are determined such that the volume V1 is less than the volume Q. The volume V1 is the total volume of the internal volume of the drain pump 59, the internal volume of the connecting part 520 of the drainage mechanism 600, the internal volume of the first flow path 630, and the volume of a portion that is lower than the height position of the highest point of the flow path lower surface of the second flow path 640 and continuous with the first flow path 630 out of the internal volume of the second flow path 640. However, in modification 3D, there is no portion that is lower than the height position of the highest point of the flow path lower surface of the second flow path 640 and continuous with the first flow path 630 out of the internal volume of the second flow path 640, and the volume of that portion is zero.

With the configuration of modification 3D, even if the drain water in the space indicated by the volume V1 in FIG. 10 flows backward from the drainage mechanism 600 and the drain pump 59 and returns to the drain pan 57, the drain water does not overflow from the drain pan 57.

In modification 3D, the pipe size and the like of each of the parts 59, 520, 630, and 650 are determined such that, out of the internal space of the third flow path 650 of the drainage mechanism 600, the volume V2 of the part indicated by hatching in FIG. 10 is larger than the volume V1. Out of the internal space of the third flow path 650, the part indicated by hatching in FIG. 10 is a space which is not a flow path for drain water and in which air is accumulated, in a state where the drain pump 59 is operating and the drain water is drained from the drain pan 57 to the drainage mechanism 600. Since the volume V2 of this space is larger than the volume V1, even if a backflow occurs from the drainage mechanism 600 to the drain pan 57, the situation where the drain water overflows from the drain pan 57 rarely occurs.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

12: air conditioning indoor unit
57: drain pan
59: drain pump
60: drainage mechanism
62*a*: connecting part
64: first flow path
64C: center line of internal flow path of first flow path
64T: highest point of first flow path
65: folded part
65*a*: first end
65*b*: second end
65C: center line of internal flow path of folded part
65T: highest point of folded part
68: second flow path
68C: center line of internal flow path of second flow path
68T: highest point of second flow path
68*c*: curved part
70: collecting pipe for discharge (discharge flow path)
160: drainage mechanism
162: connecting part
164: first flow path
165: container (folded part)
165*a*: first end
165*b*: second end
165*c*: switching member
165*d*: silencing member
260: drainage mechanism
265: container (folded part)
265*a*: first end
265*b*: second end
265*c*: upper portion of container (elastic member)
500: drainage mechanism
520: connecting part
530: first flow path
540: second flow path
541: first end of second flow path
542: second end of second flow path
550: third flow path
560: fourth flow path
570: fifth flow path
570*a*: lowest point having lowest height out of center line of internal flow path of fifth flow path
580: sixth flow path
H57: height position of upper end of drain pan
H570: height position of lowest point having lowest height out of center line of internal flow path of fifth flow path

CITATION LIST

Patent Literature

Patent Literature 1: Japanese Laid-Open Patent Application No. H5-203177

The invention claimed is:

1. A drainage mechanism connected to a drain pump that sucks water from a drain pan that receives the water in an air conditioning indoor unit, the drainage mechanism comprising:

a connecting part that connects to the drain pump;

a first flow path that extends upward from the connecting part;

a folded part that has a first end connected to an upper end of the first flow path and a second end on a side opposite to the first end, wherein the folded part changes a direction of the water flowing therein from upward to downward; and a second flow path that extends from the second end of the folded part, wherein the second flow path is a pipe that has an inner diameter of 13 mm or less, a flow path area of the folded part is larger than a flow path area of the second flow path.

2. The drainage mechanism according to claim 1, wherein the second flow path comprises a metal or resin pipe that has a curved part.

3. The drainage mechanism according to claim 1, wherein the second flow path comprises a copper pipe.

4. The drainage mechanism according to claim 1, wherein
a flow path area of the first flow path is larger than the flow path area of the second flow path.

5. The drainage mechanism according to claim 4, wherein
the flow path area of the first flow path is equal to the flow path area of the folded part, and
the first flow path and the folded part are continuous.

6. The drainage mechanism according to claim 1, wherein
a flow path area of the first flow path is smaller than the flow path area of the folded part.

7. The drainage mechanism according to claim 1, wherein
a highest point of a center line of an internal flow path of the folded part is disposed higher than any of a highest point of a center line of an internal flow path of the first flow path, and a highest point of a center line of an internal flow path of the second flow path.

8. The drainage mechanism according to claim 1, wherein
a height direction distance between a highest point of a center line of an internal flow path of the folded part and the connecting part is 200 to 500 mm.

9. The drainage mechanism according to claim 1, wherein
a height direction distance between a highest point of a center line of an internal flow path of the folded part and the second end is 50 to 700 mm.

10. The drainage mechanism according to claim 1, wherein
the folded part comprises a container.

11. The drainage mechanism according to claim 10, wherein
the container comprises an elastic member, and
the elastic member closes an internal flow path of the container by elastic deformation.

12. The drainage mechanism according to claim 10, wherein
the container comprises a switching member that switches between a communication state and a non-communication state of an internal space and an external space, and
when a pressure of the internal space of the container decreases to less than a predetermined value, the switching member switches from the non-communication state to the communication state, and causes air from the external space to be taken into the internal space of the container.

13. An air conditioning system comprising the drainage mechanism according to claim 1, and further comprising:
the air conditioning indoor unit including the drain pan and a heat exchanger disposed above the drain pan; and
the drain pump that sucks water from the drain pan, wherein
the drainage mechanism is connected to the drain pump.

14. A drainage mechanism connected to a drain pump that sucks water from a drain pan that receives the water in an air conditioning indoor unit, the drainage mechanism comprising:
a connecting part that connects to the drain pump;
a first flow path that extends upward from the connecting part;
a second flow path that has a first end connected to an upper end of the first flow path and a second end on a side opposite to the first end, wherein the second flow path changes a direction of the water flowing therein from upward to downward;
a third flow path that extends downward from the second end of the second flow path; and
a fourth flow path that extends from the third flow path, wherein
the fourth flow path is a pipe that has an inner diameter of 13 mm or less,
a flow path area of the fourth flow path is smaller than at least one of a flow path area of the second flow path and the third flow path.

15. The drainage mechanism according to claim 14, wherein
the second flow path and the third flow path are one pipe and are continuous.

16. The drainage mechanism according to claim 15, wherein
the second flow path and the third flow path are one copper pipe, and
an inner diameter of the second flow path and the third flow path is larger than an inner diameter of the fourth flow path.

17. The drainage mechanism according to claim 14, wherein
the fourth flow path comprises one or more copper pipes.

18. The drainage mechanism according to claim 15, wherein
the inner diameter of the second flow path and the third flow path is at least 1.5 times larger than the inner diameter of the fourth flow path.

19. The drainage mechanism according to claim 14, further comprising
a fifth flow path that is continuous with the fourth flow path, wherein
the fourth flow path is disposed between the third flow path and the fifth flow path,
a height position of a lowest point of a center line of an internal flow path of the fifth flow path is:
disposed lower than any point of a center line of an internal flow path of the fourth flow path, and
disposed lower than a height position of an upper end of the drain pan.

20. The drainage mechanism according to claim 19, further comprising
a sixth flow path that is continuous with the fifth flow path,
wherein a height position of any point of a center line of an internal flow path of the sixth flow path is higher than the height position of the lowest point of the fifth flow path, and
the sixth flow path is disposed between a discharge flow path, for discharging the water to an outside, and the fifth flow path.

21. The drainage mechanism according to claim 14, wherein
when the drain pump is operating out of an internal space of the drain pan, a part of the internal space above a water level of the drain pan has a volume that is greater than or equal to a total volume of an internal volume of the drain pump, an internal volume of the connecting part, an internal volume of the first flow path, and a volume of a portion, of an internal volume of the second flow path, that is lower than a height position of a highest point of a flow path lower surface of the second flow path and continuous with the first flow path.

* * * * *